US007734213B2

(12) United States Patent
Fukuta et al.

(10) Patent No.: US 7,734,213 B2
(45) Date of Patent: Jun. 8, 2010

(54) DEVELOPING DEVICE, PROCESS CARTRIDGE, AND IMAGE FORMING APPARATUS

(75) Inventors: Hiroya Fukuta, Nagoya (JP); Bak Kyo Suh, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 352 days.

(21) Appl. No.: 11/956,450

(22) Filed: Dec. 14, 2007

(65) Prior Publication Data

US 2008/0145093 A1 Jun. 19, 2008

(30) Foreign Application Priority Data

Dec. 14, 2006 (JP) ..... 2006-336567
Jul. 9, 2007 (JP) ..... 2007-179337

(51) Int. Cl.
*G03G 15/08* (2006.01)

(52) U.S. Cl. ..... 399/103; 399/105

(58) Field of Classification Search ..... 399/98, 399/103–107, 111, 119, 120
See application file for complete search history.

(56) References Cited

U.S. PATENT DOCUMENTS 6,336,014 B1 * 1/2002 Sato et al. ..... 399/103
6,980,752 B2 * 12/2005 Kamimura ..... 399/103
7,627,264 B2 * 12/2009 Matsushita et al. ..... 399/103
2006/0024085 A1 2/2006 Sato

FOREIGN PATENT DOCUMENTS

JP 2-146072 A 6/1990
JP 2006-039430 A 2/2006

* cited by examiner

*Primary Examiner*—Hoan Tran
(74) *Attorney, Agent, or Firm*—Banner & Witcoff, Ltd.

(57) ABSTRACT

A secure seal is provided between a blade unit and a housing in a developer unit of an image forming apparatus by utilizing a sheet member configured to cover a step height formed on a surface of the blade unit facing a sealing member.

19 Claims, 9 Drawing Sheets

DEVELOPING DEVICE, PROCESS CARTRIDGE, AND IMAGE FORMING APPARATUS

CROSS REFERENCE TO RELATED APPLICATION

This application claims priority from Japanese Patent Application Nos. 2006-336567, filed on Dec. 14, 2006, and 2007-179337, filed on Jul. 9, 2007, the entire subject matter of which is incorporated herein by reference.

FIELD

Aspects of the invention relate to a developing device, a process cartridge and an image forming apparatus.

BACKGROUND

An image forming apparatus, e.g. a laser printer, is designed to form an image on a recording sheet by forming an electrostatic latent image on a surface of a photosensitive drum, supplying a developer to the latent image, transferring a developer image formed on the surface of the photosensitive drum onto the recording sheet, and fixing the transferred image on the recording sheet by heat.

The laser printer may include a process cartridge. The process cartridge may include a housing, a developer stored in the housing, a developing roller carrying the developer, and a blade unit configured to regulate a layer thickness of the developer applied to the developing roller. The blade unit may include a blade like a spatula extending in a width direction of a recording sheet. Typically the blade has a leaf spring. The blade is pressed against the developing roller to regulate the layer thickness of the developer.

The blade unit is disposed in such a manner as to close an opening of the process cartridge's housing. When the opening is closed, a sealing member is sandwiched between a blade attaching portion on the housing and the blade unit in order to prevent the developer from leaking out from the housing.

The blade unit includes a reinforcing plate to reinforce the blade. A step height between the blade and the reinforcing plate and a screw for fixing the blade and the reinforcing plate causes the surface of the blade unit to be uneven. Such an uneven surface is also present on a side of the blade unit mounted to the housing.

A sealing member is provided between the blade unit and the blade attaching portion; however, a gap can occur between the sealing member and the blade unit due to the uneven surface on the blade unit. Such a gap may allow toner to leak out of the housing. The seal between the sealing member and the blade unit can be improved if the flat surface area of the blade unit surrounding the uneven surface portion of the blade unit is sufficiently large to offset the effect of the uneven surface portion. This is an acceptable solution in a large-sized image forming apparatus; however, this solution is not feasible in today's desired small-sized image forming apparatus. Instead, in such small-sized image forming apparatuses, it is desired to reduce the size of the flat surface on the blade unit as much as possible for sealing between the blade unit and the housing.

SUMMARY

Aspects of the invention provide a secure seal between a blade unit and a housing even if the blade unit has an uneven surface.

BRIEF DESCRIPTION OF THE DRAWINGS

Illustrative aspects of the invention will be described in detail with reference to the following figures in which like elements are labeled with like numbers and in which.

DETAILED DESCRIPTION

An illustrative embodiment of the invention will be described in detail with reference to the accompanying drawings. An image forming apparatus according to aspects of the invention is applied to a laser printer. It will be appreciated that aspects of the invention apply to other types of image forming apparatuses as well.

An internal structure of an illustrative laser printer 1 will be now described with reference to FIG. 1.

Figure 1:
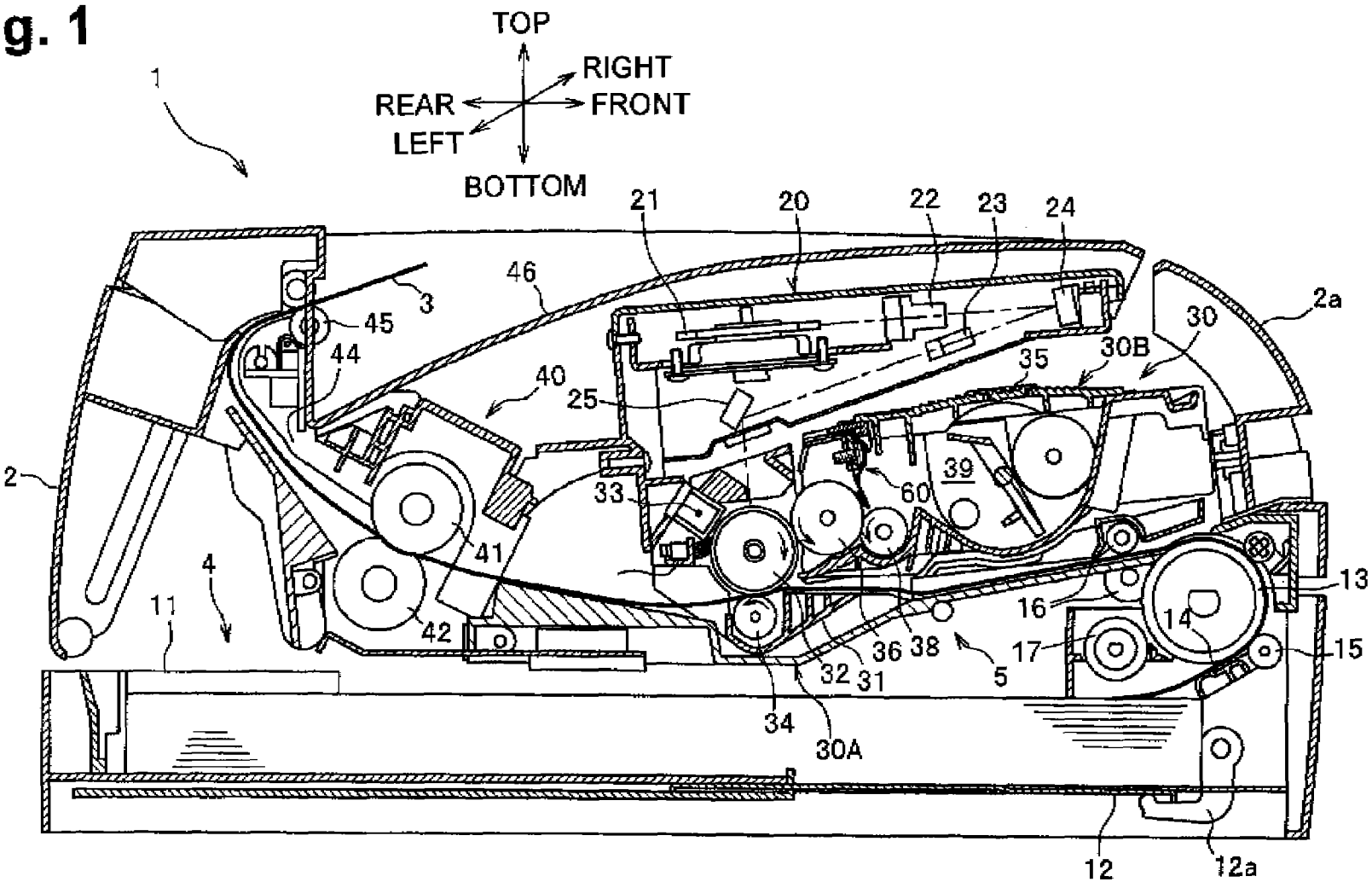
FIG. 1 is a side sectional view of a laser printer according to an aspect of the invention.

An upper side of FIG. 1 is referred to as the top of the laser printer 1, and the right side of FIG. 1 is referred to as the front side of the laser printer 1. For ease of discussion, in the following description, the top or upper side, the bottom or lower side, the left or left side, the right or right side, the front or front side, and the rear or rear side of the laser printer 1 will be identified as indicated by the arrows in FIG. 1. With regard to various individual objects of the laser printer 1, sides of the individual objects will be similarly identified based on the arranged attached position of the object on/in the laser printer 1 shown in FIG. 1. The top and bottom direction may be referred to as a height direction, and the left and right direction may be referred to as a width direction.

As shown in FIG. 1, the laser printer 1 may include a feeder unit 4, and an image forming unit 5. The feeder unit 4 is configured to supply a recording sheet 3, such as plain paper or transparency, in an apparatus casing 2. The image forming unit 5 is configured to form an image onto a supplied recording sheet.

A front cover 2*a* is disposed at the front of the apparatus casing 2. A process cartridge 30 is attached to and removed from the apparatus casing 2 through an opening formed when the front cover 2*a* is open.

The feeder unit 4 may include a sheet supply tray 11, a sheet pressing plate 12, and a lift lever 12*a*. The sheet supply tray 11 may be attached to and removed from the lowermost part of the apparatus casing 2, and may be configured to hold a stack of recording sheets. The sheet pressing plate 12 may be pivotally disposed in a lower part of the sheet supply tray 11 so as to lift the front of the sheet supply tray 11. The lift lever 12*a* may be configured to lift the sheet pressing plate 12 from the bottom. A pickup roller 17, a sheet supply roller 13, and a sheet supply pad 14 may be disposed at the front of and above the sheet supply tray 11. A pinch roller 15 may be disposed facing the sheet supply roller 13 from below. A register roller 16 may be disposed at the rear of the sheet supply roller 13.

In the feeder unit 4, the sheet supply tray 11 storing a stack of recording sheets 3 is lifted by the lift lever 12*a* and the sheet pressing plate 12, and some upper sheets are fed to the sheet supply roller 13 by the pickup roller 17. Of the upper sheets, a topmost sheet only is fed to the pinch roller 15 due to a friction between the sheet supply roller 13 and the sheet supply pad 14, and further fed to the image forming unit 5. In this manner, a recording sheet 3 is singly fed to the image forming unit 5.

The image forming unit 5 may include a scanner unit 20, the process cartridge 30, and the fixing unit 40.

The scanner unit 20 may be disposed in an upper portion of the apparatus casing 2, and may include a laser light source (not shown), a polygon mirror 21, lenses 22, 23, and reflecting mirrors 24, 25. As shown in a broken/dotted line, a laser beam emitted from the laser light source, based on image data, may be deflected by the polygon mirror 21, pass through the lens 22, be folded by the reflecting mirror 24, and pass through the lens 23, and be folded by the reflecting mirror 25 to be directed to a surface of a photosensitive drum 32 in the process cartridge 30 by high speed scanning.

The process cartridge 30 may be disposed below the scanner unit 20. The process cartridge may be attached to and removed from the apparatus casing 2. The process cartridge 30 may include a drum cartridge 30A and a toner cartridge 30B. The drum cartridge 30A is configured to support the photosensitive drum 32. The toner cartridge 30B is configured to be attached to and removed from the drum cartridge 30A and store toner as a developer inside.

The drum cartridge 30A may include the photosensitive drum 32, a scorotron charger 33, and a transfer roller 34 in a drum cartridge case 31.

The toner cartridge 30B is an example of a developing device. The toner cartridge 30B is detachably attached to the drum cartridge 30A, and includes a developing roller 36, a blade unit 60, a supply roller 38, and a toner hopper 39 in a cartridge housing 35. The developing roller 36 and the supply roller 38 are rotatably supported by the cartridge housing 35. Toner in the toner hopper 39 is supplied to the developing roller 36 as the supply roller 38 rotates in a direction of an arrow (counterclockwise) in FIG. 1. Toner is positively charged by friction between the supply roller 38 and the developing roller 36. Blade unit 60 regulates the toner supplied to the developing roller 36 to form a thin layer of uniform thickness on the developing roller 36.

The photosensitive drum 32 is supported by the drum cartridge case 31 so as to rotate in a direction of an arrow (clockwise) shown in FIG. 1. A drum body of the photosensitive drum 32 is grounded, and a grounded area of the drum body is formed of a positively charged photosensitive layer.

The scorotron charger 33 is disposed away from the photosensitive drum 32, so as to face the photosensitive drum 32 from above. The scorotron charger 33 according to this illustrative aspect may be configured to charge the surface of the photosensitive drum 32 substantially uniformly and positively by generating a corona discharge from a charging wire made of tungsten or the like.

The transfer roller 34 is an example of a transferring device. The transfer roller 34 may be disposed in contact with the photosensitive drum 32 from below, and supported by the drum cartridge case 31 so as to rotate in a direction of an arrow (counterclockwise) shown in FIG. 1. The transfer roller 34 may be formed by covering a metal roller shaft with a conductive rubber material. The transfer roller 34 is subjected to a transfer bias during image transfer by constant current control.

The surface of the photosensitive drum 32 is charged uniformly and positively by the scorotron charger 33, and then exposed to a laser beam emitted from the scanner 20 at high speed. A potential at an exposed area is lowered and an electrostatic latent image is formed based on the image data. That is, an electrostatic latent image is an exposed area of the surface of the photosensitive drum 32 uniformly charged positively, where potential is lowered due to exposure to laser radiation. Then, the developing roller 36 rotates in contact with the photosensitive drum 32, and toner carried on the developing roller 36 is supplied to an electrostatic latent image formed on the photosensitive drum 32. Toner is selectively carried on the photosensitive drum 32, and a toner image is formed by reversal.

The recording sheet 3 is sandwiched and fed between the photosensitive drum 32 and the transfer roller 34, which are rotated. While the recording sheet 3 is fed between the photosensitive drum 32 and the transfer roller 34, the toner image carried on the surface of the photosensitive drum 32 is transferred onto the recording sheet 3.

The fixing unit 40 is an example of a fixing device. The fixing unit 40 may be disposed downstream of the process cartridge 30. The fixing unit 40 may include a heat roller 41 and a pressure roller 42. The pressure roller 42 may be disposed to face the heat roller 41 from below and configured to press against the beat roller 41. In the fixing unit 40, toner transferred onto the recording sheet is fixed by heat while passing through between the heat roller 41 and the pressure roller 42, and fed to a sheet discharge path 44. The recording sheet 3 fed to the sheet discharge path 44 is discharged to a sheet discharge tray 46 by a sheet discharge roller 45.

Figure 2:
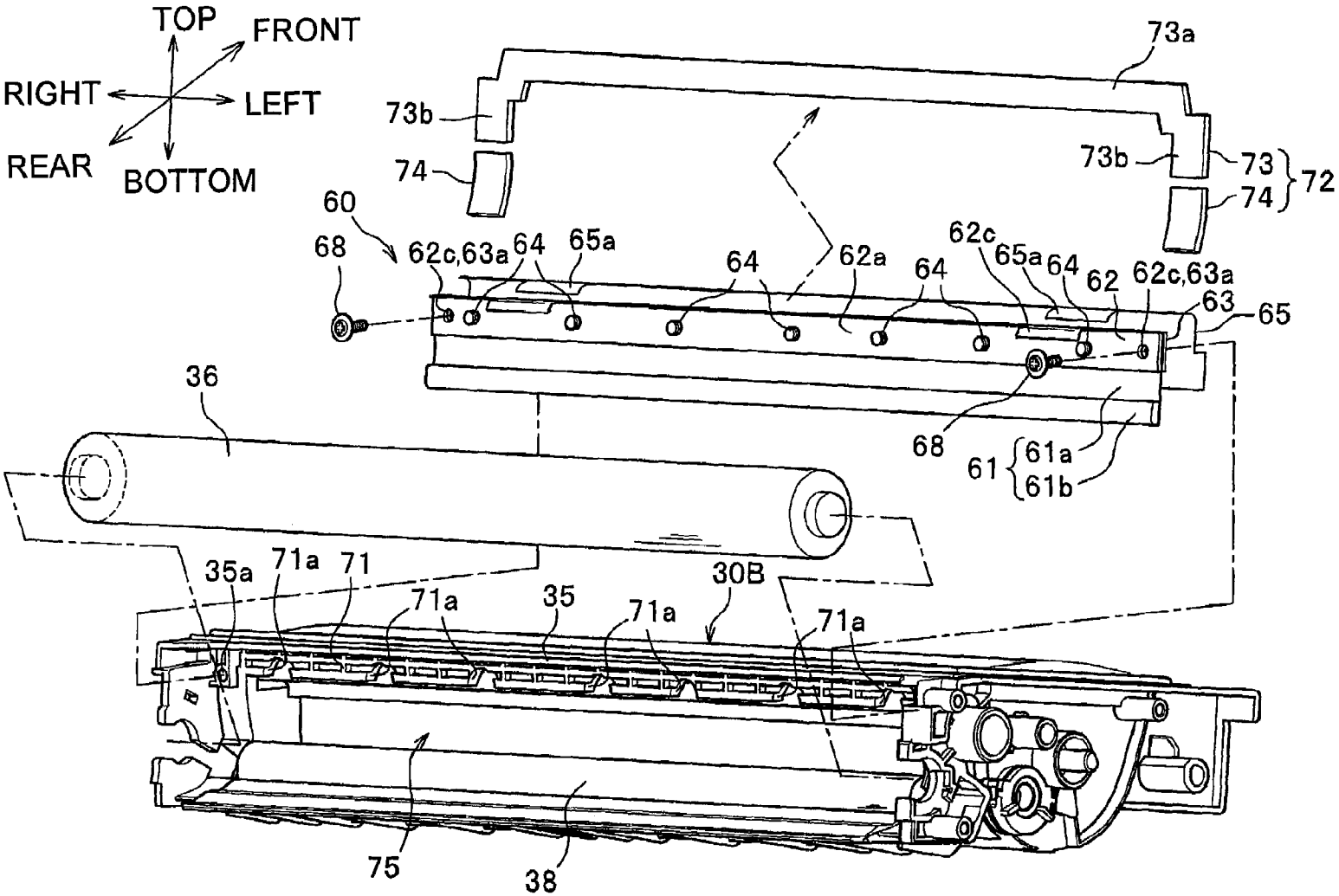
FIG. 2 is an exploded perspective view of a toner cartridge according to an aspect of the invention.

As shown in FIG. 2, the cartridge housing 35 of the toner cartridge 30B is provided with an opening 75 at a side facing the drum cartridge 30A.

Figure 4:
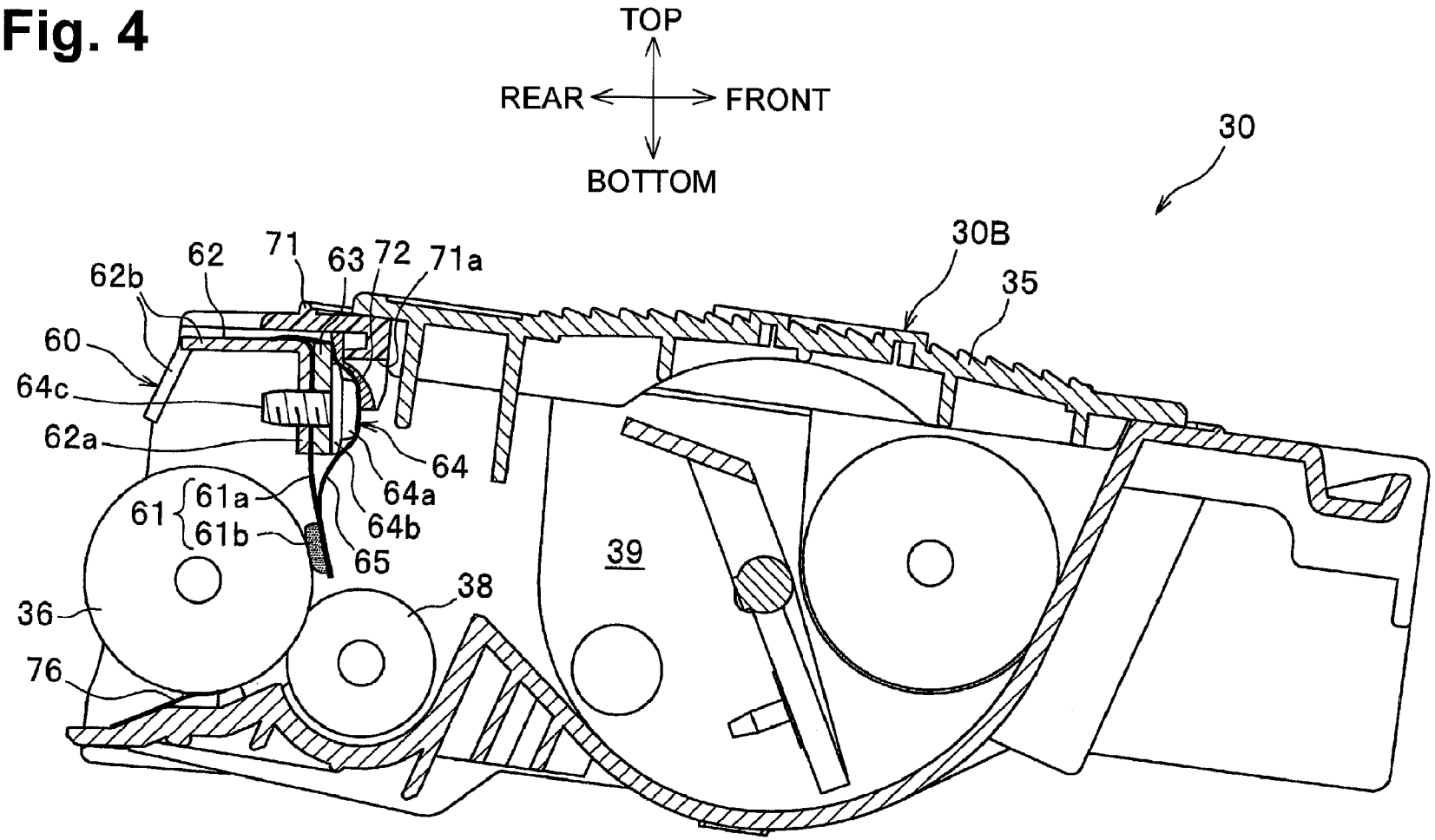
FIG. 4 is an enlarged sectional view of the toner cartridge of FIG. 2.

The cartridge housing 35 has a low-profile shape in order to make the laser printer 1 compact in size. In accordance with the low-profile shape of the cartridge housing 35, the opening 75 extends in the width direction and is short in the height direction. As shown in FIG. 4, a blade attaching member 71 is fixed, e.g. bonded, to the cartridge housing 35, to define an upper portion and both sides of the opening 75. As shown in FIG. 2, the blade attaching member 71 is formed with a lattice-shaped rib structure on a surface (facing the drum cartridge 30A) extending in the width direction. The lattice-shaped rib structure of the blade attaching member 71 is formed with seven semicircular cutout portions 71*a* spaced apart in the width direction. The cutout portions 71*a* are provided at a lower end of the lattice-shaped rib structure above the opening 75 to avoid interference of head portions 64*a* of flanged screws 64 (FIG. 4).

The blade attaching member 71 is also short in the height direction, in accordance with the low-profile shape of the cartridge housing 35. The blade attaching member 71 is very thin, especially where the cutout portions 71*a* are formed, typically only a few millimeters high.

Figure 3:
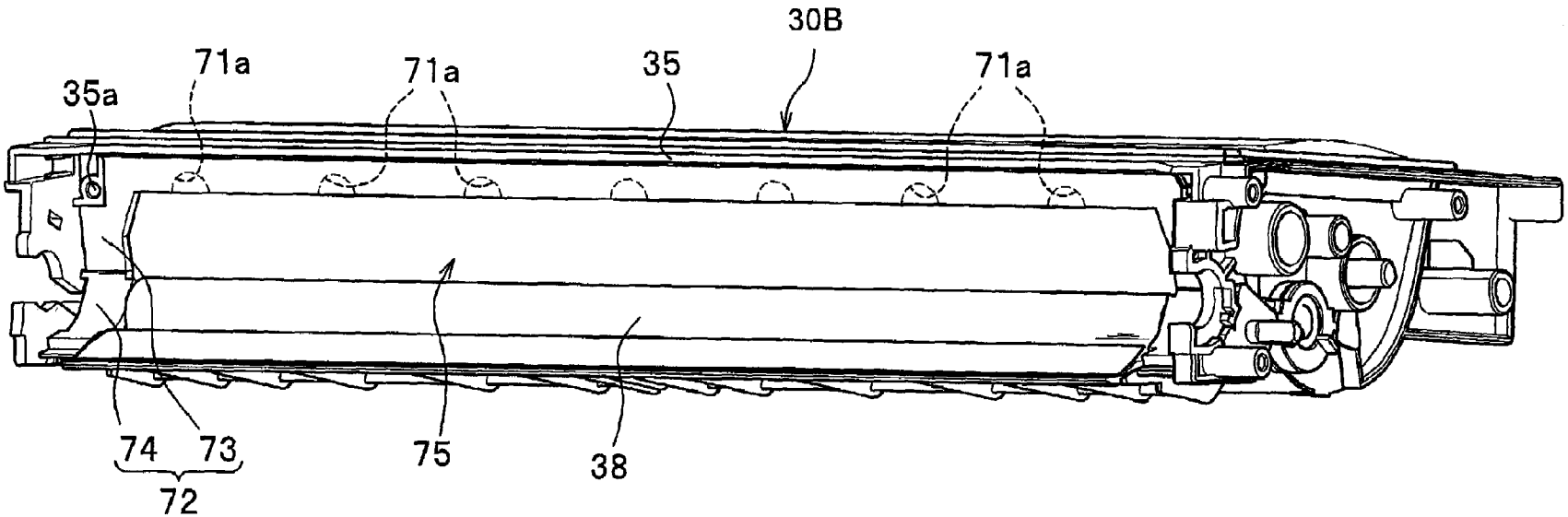
FIG. 3 is a perspective view of the toner cartridge shown in FIG. 2 where sealing members are attached.

The blade attaching member 71 is formed with screw holes 35*a* at both ends to face the drum cartridge 30A. In FIGS. 2 and 3, only one screw hole 35*a* is shown.

A sealing member 72 is attached to the blade attaching member 71 with a double-sided tape or adhesive. The sealing member 72 is made from a sheet of a flexible member, e.g. a synthetic resin sponge, and has a contour substantially matching that of the blade attaching member 71.

The sealing member 72 includes an upper seal 73 and a lower seal 74. The upper seal 73 is made up of a main seal portion 73*a* and side seal portions 73*b*. The main seal portion 73*a* extends laterally at a fixed width (a dimension in the height direction) in association with the lattice-shaped rib structure of the blade attaching member 71. The main seal portion 73*a* does not include shapes corresponding to the cutout portions 71*a*. The side seal portions 73*b* extend downward from both ends of the main seal portion 73*a*. There are provided two lower seals 74 so as to connect with the side seal portions 73*b* of the upper seal 73.

In this embodiment, the sealing member 72 is divided into the upper seal 73 and the lower seals 74. However, the upper seal 73 and the lower seals 74 may be combined into one.

The sealing member 72 is attached to the blade attaching member 71 in the housing 3 as shown in FIG. 3. The blade unit 60 is attached to the housing 3 as shown in FIG. 2. The blade unit 60 is fixed to the cartridge housing 35 by inserting two screws 68 into through holes 62*c*, 63*a* (FIGS. 2 and 5B) and the screw holes 35*a*, and fastening them.

Figure 5A:
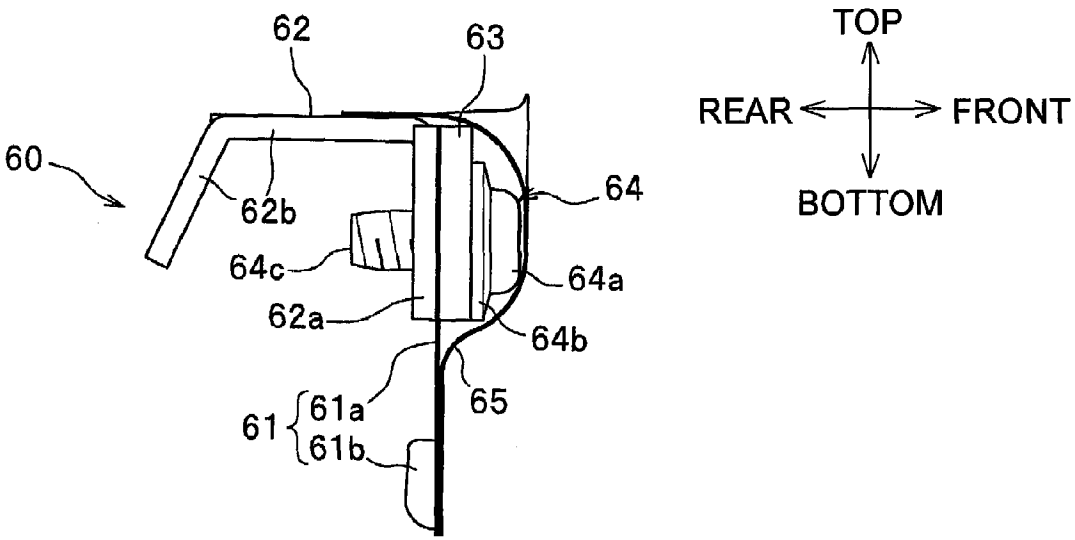
FIG. 5A is a side view of a blade unit according to an aspect of the invention.

The blade unit 60 may include a blade 61, a blade holder 62, a reinforcing plate 63, and flanged screws 64. As shown in FIG. 5A, the blade 61, the blade holder 62, the reinforcing plate 63 are coupled with the flanged screws 64.

The blade 61 may include a leaf spring 61*a* and a pressing member 61*b* disposed along the lower end of the leaf spring 61*a*. The leaf spring 61*a* is made from a rectangular thin metal plate extending in an axial direction of the developing roller 36. The leaf spring 61*a* has flexibility to produce an urging force against the developing roller 36. The leaf spring 61*a* is formed with through holes for the flanged screws 64 to pass through as shown in FIG. 4. The pressing member 61*b* is made of rubber, and protrudes toward the developing roller 36 in cross section. The pressing member 61*b* is fixed at the lower end of the leaf spring 61*a*. The pressing member 61*b* is configured to contact the developing roller 36 at the protruding portion and regulate a layer of toner applied to the surface of the developing roller 36 to a uniform thickness.

The blade holder 62 is made of a rigid metal plate and is thicker than the blade 61. The blade holder 62 is configured to support the blade 61. The blade holder 62 may include a supporting portion 62*a* and a holding portion 62*b*. The supporting portion 62*a* extends along the upper end of the blade 61 with a constant width. The holding portion 62*b* extends rearward from the supporting portion 62*a*. The supporting portion 62*a* is formed with screw holes spaced apart from one another. In FIG. 2, the supporting portion 62*a* is formed with seven screw holes in which the flanged screws 64 are inserted. The supporting portion 62*a* is formed at both ends with through holes 62*c* in which screws 68 are inserted as shown in FIG. 2. The through holes 62*c* are formed at positions corresponding to the screw holes 35*a* of the cartridge housing 35.

Figure 5B:
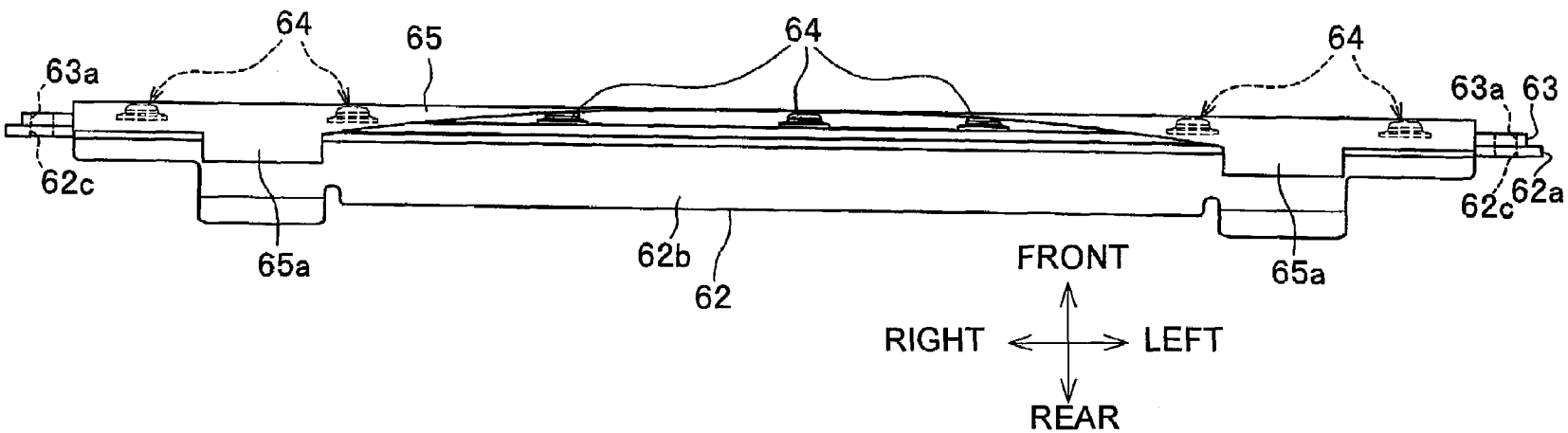
FIG. 5B is a plan view of the blade unit of FIG. 5A.

The reinforcing plate 63 is made of a rigid metal plate thicker than the blade 61. The reinforcing plate 63 is configured to sandwich the blade 61 with the blade holder 62 and prevent undulation of the blade 61. The reinforcing plate 63 has a generally rectangular shape similar to supporting portion 62*a* of the blade holder 62, and is formed with through holes in the same number as the screw holes of the supporting portion 62*a*, e.g. seven holes in FIG. 2. The reinforcing plate 63 is also formed at both ends with through holes 63*a* corresponding to the through holes 62*c* of the blade holder 62, as shown in FIG. 5B.

The blade holder 62, the blade 61, and the reinforcing plate 63 are overlaid on one another in this order, and assembled as the blade unit 60 by inserting flanged screws 64 into the screw holes formed in the supporting portion 62*a* of the blade holder 62 from the reinforcing plate 63 side.

Each flanged screw 64 may integrally include a head portion 64*a*, a flanged portion 64*b*, and a threaded shank 64*c*. The head portion 64*a* is engageable with a plus driver. The flanged portion 64*b* is disposed neighboring the head portion 64*a*. The threaded shank 64 extends from the flanged portion 64*b*.

The head portion 64*a* and the flanged portion 64*b* protrude from the reinforcing plate 63 when each flanged screw 64 is screwed into the blade holder 62. Such protrusion causes an uneven surface on the reinforcing plate 63. The uneven surface faces the sealing member 72 attached onto the blade attaching member 71 when the blade unit 60 is attached to the cartridge housing 35. A sheet member 65 covers the head portion 64*a* and the flanged portion 64*b* to provide a smooth outer shape of the blade unit 60.

The sheet member 65 may be made of a sheet of resin, e.g. plastic, and has a moderate flexibility. The sheet member 65 may be a polyethylene terephthalate (PET) sheet 0.05-0.075 mm thick. To fix the blade unit 60 covered with the sheet member 65 to the cartridge housing 35, as described above, two screws 68 are inserted into the through holes 62*c*, 63*a* (FIGS. 2 and 5B), which are formed at both ends of the blade holder 62 and the reinforcing plate 63, and then screwed into the screw holes 35*a* of the cartridge housing 35. However, as the screws 68 are fastened, the sealing member 72 is pushed by the blade unit 60 and elastically deformed in contact with the sheet member 65 in a direction of thickness. When the screws 68 are completely fastened, the sealing member 72 disposed on the cartridge housing 35 and the sheet member 65 disposed on the blade unit 60 remain in contact with each other.

The sheet member 65 is used to cover the step height on the blade unit 60 to provide a smooth outer shape. Preferably, the sheet member 65 has such a degree of flexibility that it can bend easily and gently to reduce the effect of the step height as much as possible. If the sheet member 65 has little or no flexibility, the sheet member 65 cannot be attached to the blade unit 60 by bending, or a gap may be created on a contact surface between the sheet member and the blade unit 60 when the blade 61 is deformed.

The sheet member 65 needs to maintain its outer shape in order to effectively cover the step height both before and after contact with the sealing member 72. More specifically, it is desired that the sheet member 65 has a small elongation percentage in a surface direction when pressed by the sealing member 72. This is because, when the sheet member 65 is pressed by the sealing member 72 and elongates, the sheet member 65 may deform in accordance with the shape at the step height on the blade unit 60, and toner may leak out from the gap between the sealing member 72 and the deformed sheet member 65. The sheet member 65 preferably has a moderate resilience. Due to the resilience, when a force is applied by contact with the sealing member 72, the sheet member 65 wants to return to its original state allowing closer contact between the sheet member 65 and the sealing member 72.

The thickness of the sheet member 65 may vary according to materials used to satisfy the above conditions. A material for the sheet member 65 may be freely selected as long as it produces no wrinkles or breakage when the sheet member 65 is attached to the blade unit 60 and satisfies the above conditions, e.g. a moderate flexibility, a small elongation percentage in the surface direction, and a moderate resilience. Any material, e.g. paper, metal, plastic, rubber, and their combination, may be used for the sheet member 65.

The sheet member 65 is generally rectangular shaped and has a width substantially equal to that of the blade 61. As shown in FIG. 4, the sheet member 65 is attached, at a lower end thereof, to the front of the blade 61 (facing the inside of the cartridge housing 35), with a double-sided tape (not shown) across the entire width. That is, the sheet member 65 is attached to the blade 61 closer to a lower end side of the blade 61 or a distal end side of the blade unit 60 than the step height between the blade 61 and the reinforcing plate 63.

Figure 6A:
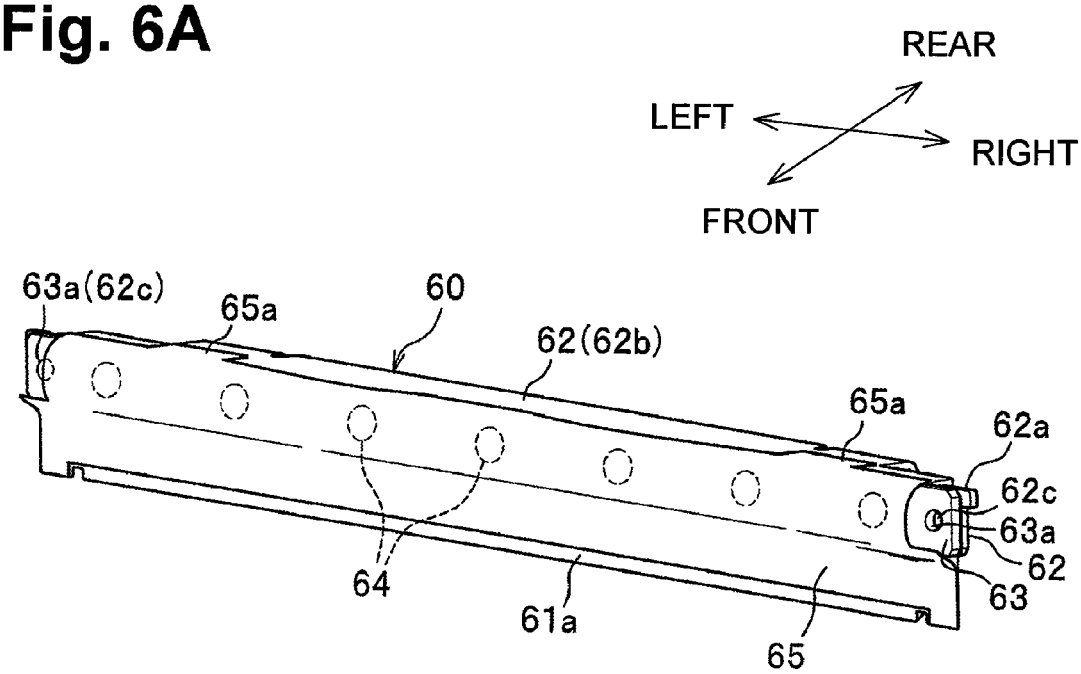
FIG. 6A is a perspective view of the blade unit according to an aspect of the invention.

The sheet member 65 extends upward from the lower end of the blade 61 to cover the flanged screws 64. The sheet member 65 includes two attaching portions 65*a* protruding rearward as shown in FIGS. 5B and 6A. The attaching portions 65*a* are formed near both sides of the upper end of the sheet member 65. The attaching portions 65*a* are fixedly attached to the holding portion 62*b* of the blade holder 62 so as to prevent the sheet member 65 from fluttering. Thus, in the perimeter of the generally rectangular shaped sheet member 65, the lower end and two places of the upper end are secured, while remaining ends are free ends. That is, in the perimeter of the sheet member 65, the upper end (except for the attaching portions 65*a*) and side ends are free ends.

The sealing member 72 is disposed so as to contact the free ends of the sheet material 65. In other words, the main seal portion 73*a* of the sealing member 72 is disposed in correspondence with the upper end of the sheet member 65, the side seal portions 73*b* and the lower seals 74 are disposed in correspondence with the side ends of the sheet member 65. Thus, the sealing member 72 contacts all free ends of the sheet member 65 to prevent toner leakage.

As shown in FIG. 5B, the upper end of the sheet member 65 is fixed only at the attaching portions 65*a* formed near both sides. The upper end of the sheet member 65 is separated from the blade unit 60 and recessed frontward in a central portion. Thus, the sheet member 65 elastically contacts the sealing member 72 on a base end side of the blade unit 60 or the upper end side of the blade 61, which is disposed upward from the step height at the flanged screws 64 of the blade unit 60, providing a seal with the sealing member 72.

Figure 6B:
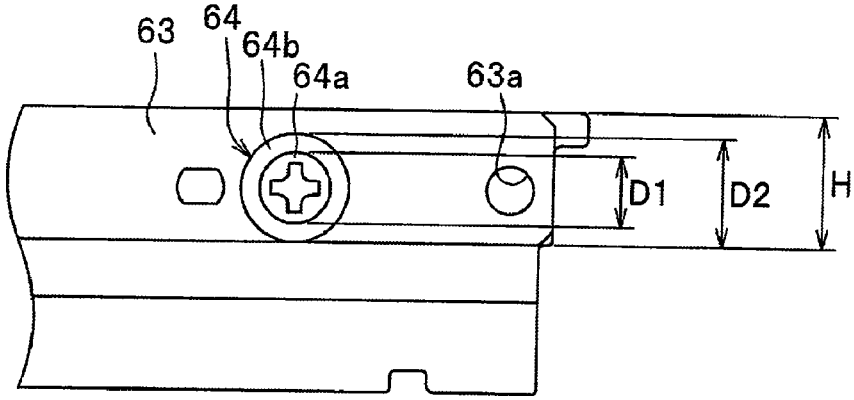
FIG. 6B is an enlarged view of a flanged screw.

As shown in FIG. 6B, D1 is a diameter of the head portion 64*a* of the flanged screw 64, D2 is a diameter of the flanged portion 64*b*, and H is a height of the reinforcing plate 63. For example, D1 is about 5.3 mm, D2 is about 8.0 mm and H is about 9.8 mm. The seal is especially effective when a difference between the height H of the reinforcing plate 63 and the diameter D2 of the flanged portion 64*b* is small. When the difference is small, a flat portion of the reinforcing plate 63 is minimized around the flanged portion 64*b* when the reinforcing plate 63 is fixed to the blade holder 62 using the flanged screw 64.

From the above reason, the seal is especially effective when a diameter of a washer of a screw for fixing the reinforcing plate 63 has a specified relation with the height H of the reinforcing plate 63. Namely, it is effective when the diameter D of the washer of the screw (i.e. diameter D2 of the flanged portion 64*b* in this embodiment) has the following relation with the height H of the reinforcing plate 63:

$$1.1 < H/D < 1.4$$

As shown in FIG. 4, the developing roller 36 is rotatably supported by the cartridge housing 35, and a lower film 76 is disposed in contact with the developing roller 36 from below to prevent toner leakage. The lower film 76 is made of a plastic film, attached to a lower edge of the cartridge housing 35 defining the opening 75, and elastically contacts the surface of the developing roller 36.

As shown in FIG. 1, the process cartridge 30, in which the toner cartridge 30B storing toner is mounted in the drum cartridge 30A, is inserted in place in the apparatus casing 2 from the front cover 2*a*.

Upon a receipt of a print request from a terminal, the laser printer 1 performs a printing operation by supplying a recording sheet 3, transferring a toner image onto the recording sheet 3, and fixing the image by heat. During this operation, toner is agitated in the toner hopper 39 and supplied to the supply roller 38.

Toner adhering to the supply roller 38 is rubbed against the developing roller 36 and then adheres to the developing roller 36. Pressing member 61*b* of the blade 61 regulates the toner adhering to the developing roller 36 to a uniform thickness.

Figure 7A:
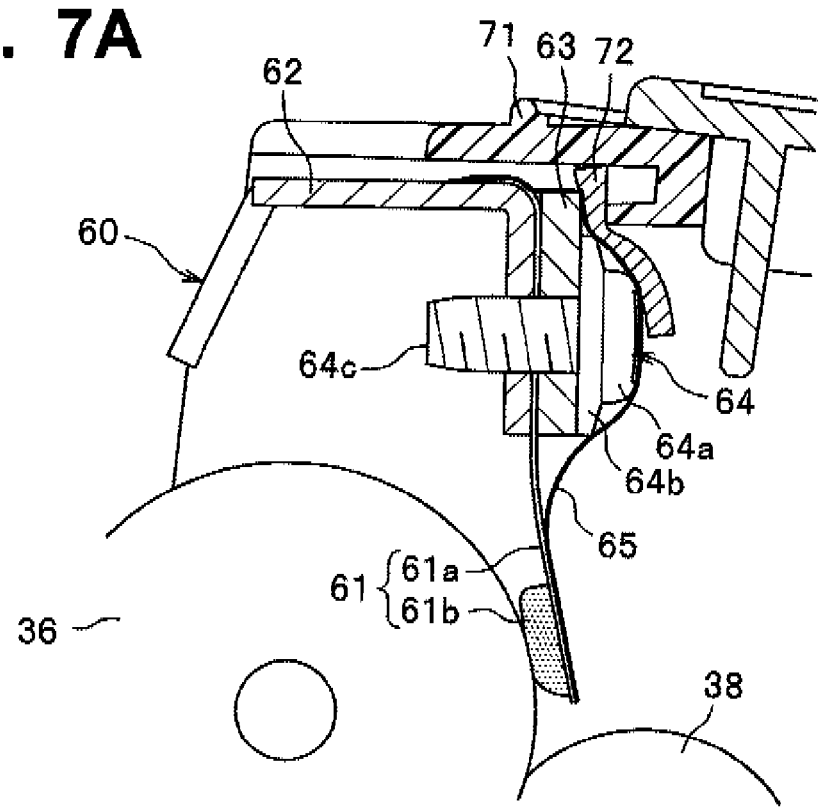
FIG. 7A is an enlarged sectional view of a sealing portion between a housing and a blade unit according to an aspect of the invention.

During this period, toner flows in the vicinity of the blade unit 60. Toner typically would partially enter between the sealing member 72 and the reinforcing plate 63. However, as shown in FIG. 7A, the sheet member 65 covers the step height between the reinforcing plate 63 and each flanged screw 64. The sheet member 65, which is gently curved, is in surface contact with the sealing member 72 with a sufficient area to prevent toner from leaking out between the sealing member 72 and the sheet member 65.

Figure 7B:
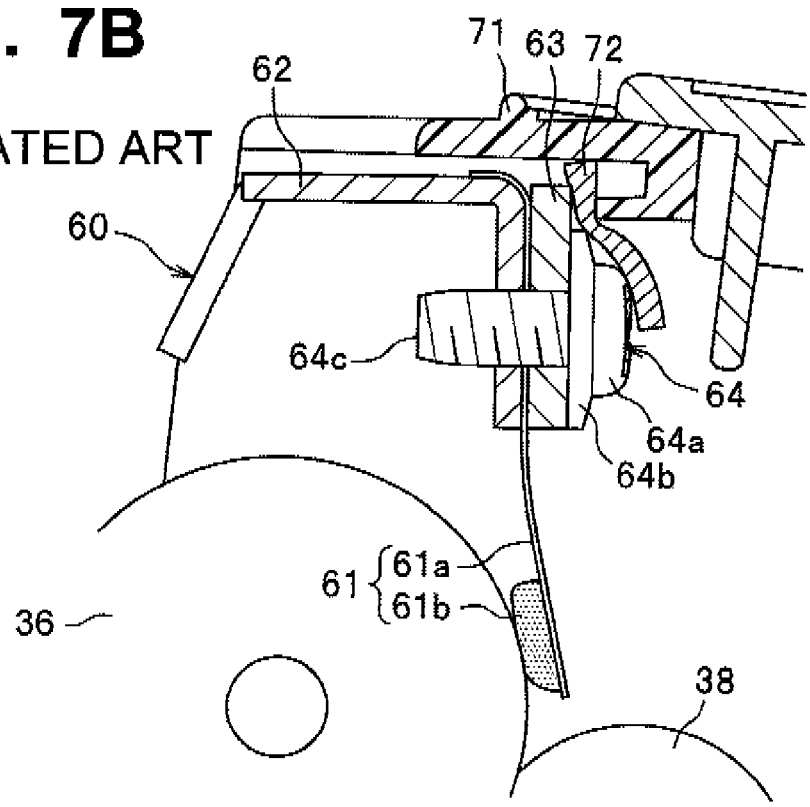
Fig. 7B RELATED ART
FIG. 7B is an enlarged sectional view of a sealing portion between a housing and a blade unit in a known toner cartridge.

As shown in FIG. 7B, in a known toner cartridge not having the sheet member 65, the sealing member 72 directly contacts the step height between the flanged screw 64 and the reinforcing plate 63. Thus, the sealing member 72 is not in surface contact with the flanged screw 64. The sealing member 72 is only in point contact with corners of the head portion 64*a* and flange portion 64*b*. In addition, the sealing member 72 is in contact with the reinforcing plate 63 only with a slight width. Thus, toner is liable to leak out from these portions where sealing is insufficient.

As the flanged screws 64 having protruding shapes are partly disposed on the blade unit 60 in the toner hopper 39, irregularities are made on the surface of the blade unit 60 along the width of the toner hopper 39, and the amount of toner in the toner hopper 39 may become uneven in the width direction. In other words, although toner is agitated and flows in the toner hopper 39, the quantity of toner may be distributed unevenly in the width direction because of the irregularities caused by the protruding shapes of the flanged screws 64, resulting in variations of printing density.

However, the toner cartridge 30B of this embodiment includes the sheet member 65 that covers the irregularities made by the flanged screws 64. The sheet member 65 is disposed so as to curve in a side view only (FIG. 7A), not in the width direction in the toner hopper 39. Thus, the irregularities are not made in the width direction in the toner hopper 39. Toner is distributed evenly in the width direction of the toner hopper 39, thus providing even printing density in the width direction.

As the irregularities of the surface of the blade unit 60 are covered with the sheet member 65, the seal between the cartridge housing 35 and the blade unit 60 can be improved and toner leakage can be prevented. Even if a sufficient seal surface is not provided on the blade unit 60 because of irregularities of the flange screws 64 and the reinforcing plate on the blade unit 60, the sheet member 65 provides a sufficient seal. Thus, the blade unit 60 can be reduced in size allowing for small-size toner cartridges 30B, process cartridges 30, and laser printers 1.

The blade attaching member 71 can be reduced in size to provide a seal between the blade unit 60 and the cartridge housing 35. Thus, the opening 75 can be increased in size, and toner flowabiltiy can be improved.

Figure 8A:
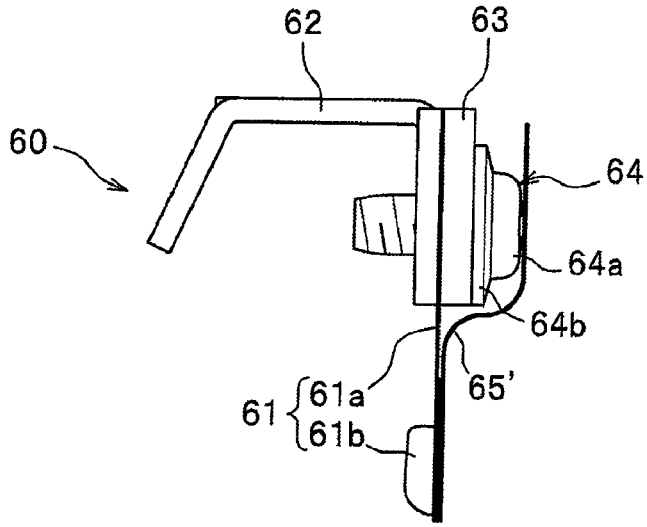
FIG. 8A is a side view of a modified blade unit according to another aspect of the invention.
Figure 8B:
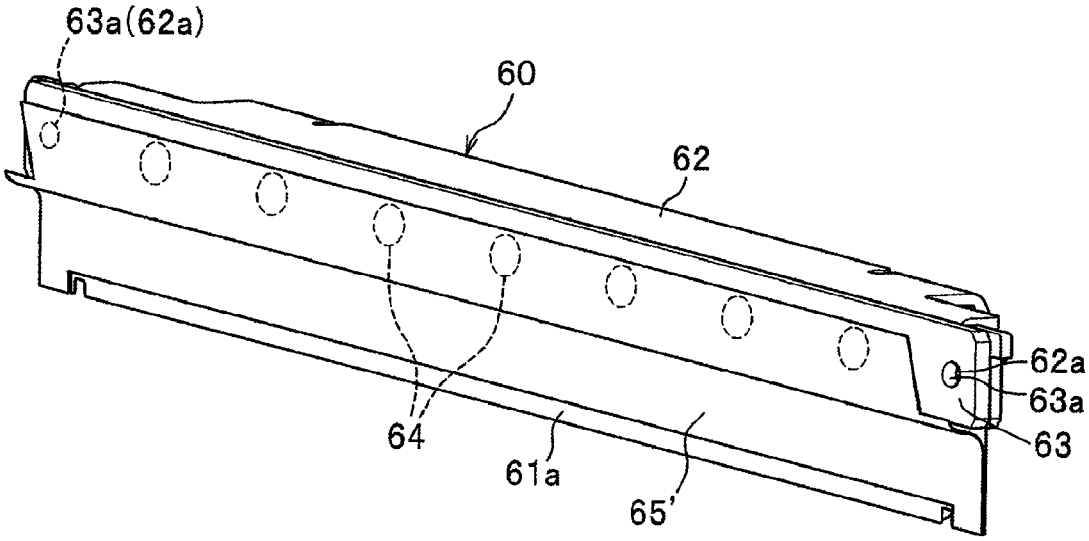
FIG. 8B is a perspective view of the blade unit of FIG. 8A.

The sheet member 65 is secured to the blade holder 62 of the blade unit 60 at both sides of the upper end of the sheet member 65 with respect to a rotation axis of the developing roller 36. The sheet member 65 is not necessarily secured at both sides of the upper end of the sheet member 65. The sheet member 65 may be secured at one side only. Alternatively, the sheet member 65 is not necessarily secured at the upper end of the sheet member 65. In a modified blade unit 60 illustrated in FIGS. 8A and 8B, a sheet member 65' is not secured to the blade holder 62 at an upper end. During assembly, the upper end of the sheet member 65' may flutter more or less and may need careful handling. However, as the sheet member 65' has elasticity and works to be urged toward the sealing member 72, the sealing member 72 and the sheet member 65' are brought into intimate contact with each other, thus improving the seal. In other words, the sheet member 65' is attached to the blade 61 closer to the distal end side of the blade unit 60 than the reinforcing plate 63 and the flanged screws 64 which provide the irregularities. The sheet member 65' is released from the blade unit 60 at the base end of the blade unit 60 or has a free end. The free end of the sheet member 65' overhangs more than the step height in a manner so as to separate from the blade unit 60. When the overhang causes the sheet member 65' to generate an urging force toward the sealing member 72, the sealing member 72 and the sheet member 65' can be brought in close contact with each other.

Figure 9:
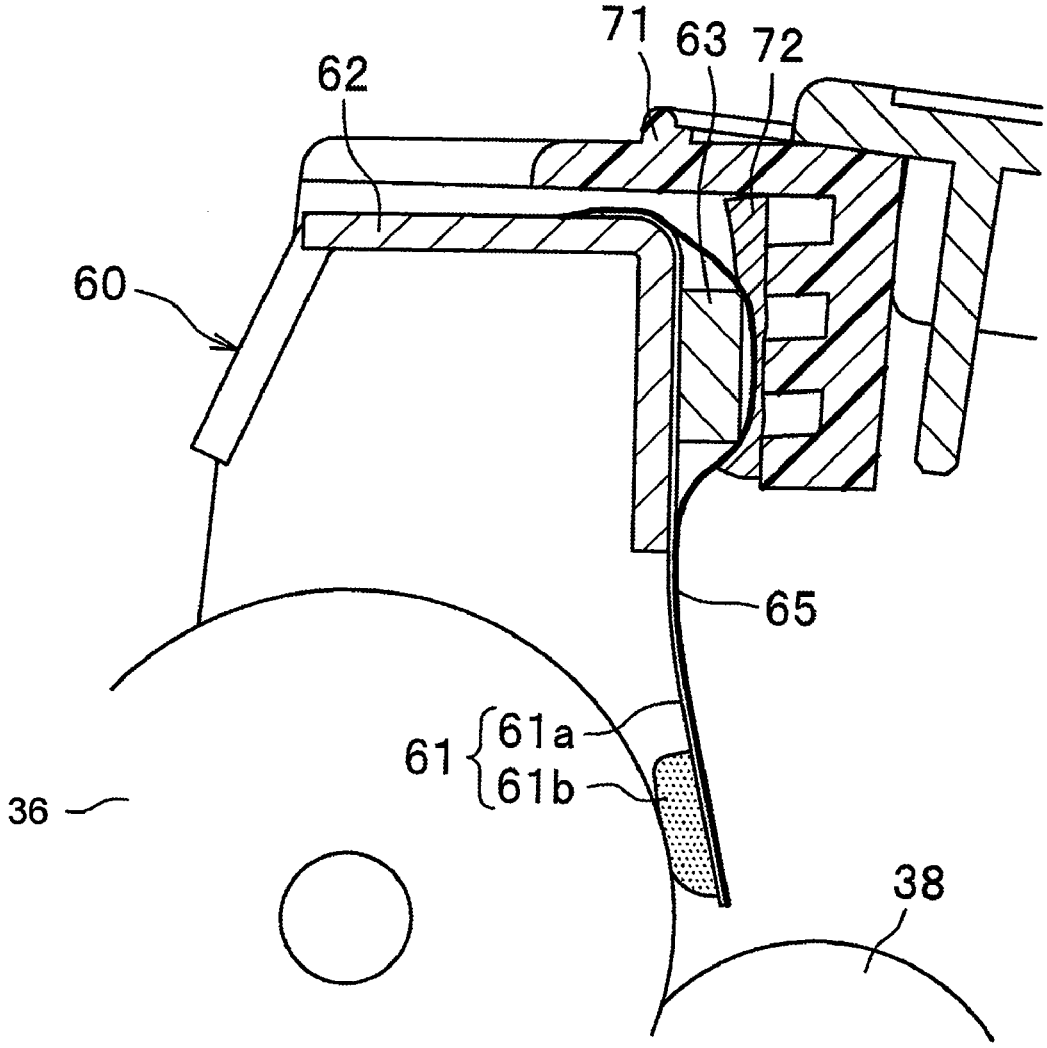
FIG. 9 illustrates a reinforcing plate and a blade in accordance with another aspect of the invention.

The sheet member 65 is used to cover the step height between the flange screws 64 and the reinforcing plate 63 in the above aspect of the invention. The sheet member 65 is used to cover the step height between the blade 61 and the reinforcing plate 63. For example, the reinforcing plate 63 and the blade 61 may be fixed by bonding, welding, or swaging, not using the flange screws 64. As shown in FIG. 9, the reinforcing plate 63 is disposed on the blade 61, and a step height is made therebetween. However, the reinforcing plate 63 is covered with the sheet member 65 to smooth the step height, and sealing by the sealing member 72 can be improved.

The invention is applied to the laser printer 1 in the above aspect of the invention. However, the invention may be applied to other image forming apparatuses, such as copiers, and multifunction devices.

Sealed portions where toner leakage might occur include the following portions: the step height between the reinforcing plate 63, the head portions 64*a* and the flanged portions 64*b* of the flange screws 64, and the step height between the blade 61 and the reinforcing plate 63. If the flange screws 64 are inserted in the direction from the blade holder 62 to the reinforcing plate 63, not in the direction from the reinforcing plate 63 to the blade holder 62, irregularities made by the threaded portion 64*c* of the flange screw 64 that protrudes from the surface of the reinforcing plate 63 may be covered with the sheet member 65 to improve the seal.

The sheet member 65 is fixed to the blade 61 with double-sided tape. Instead of double-sided tape, the sheet member 65 may be fixed to the blade 61 by use of adhesive or welding or any other suitable means.

The upper end of the sheet member 65 is fixed to the blade unit 60 at two places disposed near both ends of the upper end of the sheet member 65. The upper end of the sheet member 65 may be fixed at one of the two places.

As an example of a photosensitive member, the photosensitive drum 32 is illustrated. The photosensitive member is not limited to drum shape. The photosensitive member may be a belt or band.

While the features herein have been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. A developing device comprising:

a housing having an opening;

a sealing member disposed along the opening of the housing;

a developing roller rotatably supported by the housing and configured to carry developer on a surface of the developing roller;

a blade unit disposed in the opening of the housing to sandwich the sealing member between the blade unit and the housing, the blade unit comprising.

a blade disposed in contact with the surface of the developing roller on a first end side of the blade; and a reinforcing plate configured to reinforce the blade on a second end side opposite the first end side, and a sheet member configured to cover a step height formed on a surface of the blade unit facing the sealing member.

2. The developing device according to claim 1, wherein the step height is formed between the blade and the reinforcing plate.

3. The developing device according to claim 1, further comprising a coupling member configured to couple the blade and the reinforcing plate, wherein the step height is formed by the coupling member.

4. The developing device of claim 3 wherein the coupling member is a flanged screw.

5. The developing device according to claim 1, wherein a first step height is formed between the blade and the reinforcing plate and a second step height is formed between a coupling member and the reinforcing plate, the coupling member configured to couple the blade and the reinforcing plate.

6. The developing device according to claim 1, wherein the sheet member is attached to the blade closer to the first end side of the blade than to the step height.

7. The developing device according to claim 6, wherein at least a part of an end of the sheet member disposed on a base end side of the blade unit that is closer to the second end side than to the step height is a free end.

8. The developing device according to claim 7, wherein the sheet member is attached to the blade unit at one side or both sides of the end of the sheet member disposed on the base end side with respect to the axial direction of the developing roller, and the sheet member is not attached to the blade unit in a central portion of the end of the sheet member disposed on the base end side with respect to the axial direction of the developing roller.

9. The developing device according to claim 1, wherein the sealing member is disposed in contact with at least a free end of the sheet member.

10. A process cartridge for an image forming apparatus comprising:

the developing device of claim 1; and a photosensitive member configured to receive developer from the developing device, wherein a latent image is formed by light from a light exposure device, and the latent image is developed into a developer image with the developer received from the developing device.

11. The process cartridge according to claim 10, wherein in the developing device the step height is formed between the blade and the reinforcing plate.

12. The process cartridge according to claim 10, wherein the developing device further comprises a coupling member configured to couple the blade and the reinforcing plate, wherein the step height is formed by the coupling member.

13. The process cartridge of claim 12, wherein the coupling member is a flanged screw.

14. The process cartridge according to claim 10, wherein in the developing device a first step height is formed between the blade and the reinforcing plate and a second step height is formed between a coupling member and the reinforcing plate, the coupling member configured to couple the blade and the reinforcing plate.

15. The process cartridge according to claim 10, wherein in the developing device the sheet member is attached to the blade closer to the first end side of the blade than to the step height.

16. The process cartridge according to claim 15, wherein at least a part of an end of the sheet member disposed on a base end side of the blade unit that is closer to the second end side than to the step height is a free end.

17. The process cartridge according to claim 16, wherein the sheet member is attached to the blade unit at one side or both sides of the end of the sheet member disposed on the base end side with respect to the axial direction of the developing roller, and the sheet member is not attached to the blade unit in a central portion of the end of the sheet member disposed on the base end side with respect to the axial direction of the developing roller.

18. The process cartridge according to claim 10, wherein in the developing device the sealing member is disposed in contact with at least a free end of the sheet member.

19. An image forming apparatus configured to form an image on a recording sheet, comprising:

the process cartridge of claim 10;

a light exposure device to form the latent image on the photosensitive member of the process cartridge;

a transferring device configured to transfer the developer image formed by the process cartridge onto the recording sheet; and a fixing device configured to fix the developer image on the recording sheet.

* * * * *